US011640132B2

(12) United States Patent
Takano

(10) Patent No.: US 11,640,132 B2
(45) Date of Patent: May 2, 2023

(54) IMAGING SYSTEM WITH POLISHING CONTROL

(71) Applicant: HEWLETT-PACKARD DEVELOPMENT COMPANY, L.P., Spring, TX (US)

(72) Inventor: Katsuya Takano, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/271,156

(22) PCT Filed: Aug. 28, 2019

(86) PCT No.: PCT/US2019/048565
§ 371 (c)(1),
(2) Date: Feb. 24, 2021

(87) PCT Pub. No.: WO2020/051041
PCT Pub. Date: Mar. 12, 2020

(65) Prior Publication Data

US 2021/0191303 A1 Jun. 24, 2021

(30) Foreign Application Priority Data

Sep. 7, 2018 (JP) ..... JP2018-167844

(51) Int. Cl.
*G03G 15/00* (2006.01)

(52) U.S. Cl.
CPC ..... *G03G 15/505* (2013.01); *G03G 2215/00071* (2013.01); *G03G 2221/0089* (2013.01)

(58) Field of Classification Search
CPC ..... G03G 2215/00071
See application file for complete search history.

(56) References Cited

U.S. PATENT DOCUMENTS

| | | | | |
|---|---|---|---|---|
| 7,653,329 | B2 * | 1/2010 | Sasai | G03G 15/50 399/127 |
| 10,185,281 | B2 * | 1/2019 | Shimizu | G03G 5/14795 |
| 2009/0052948 | A1 | 2/2009 | Ozerov | |
| 2009/0147291 | A1 | 6/2009 | Kobashigawa | |
| 2010/0008689 | A1 | 1/2010 | Iwasaki et al. | |
| 2010/0086321 | A1 | 4/2010 | Burry et al. | |
| 2010/0183972 | A1 | 7/2010 | Hasegawa | |
| 2018/0135958 | A1 | 5/2018 | Kitamura | |

FOREIGN PATENT DOCUMENTS

| | | | | |
|---|---|---|---|---|
| JP | 2000081820 | A | | 3/2000 |
| JP | 2007199129 | A | * | 8/2007 |
| JP | 2010134321 | A | | 6/2010 |
| JP | 2011007848 | A | | 1/2011 |
| JP | 2011158790 | A | * | 8/2011 |
| JP | 2017009679 | A | | 1/2017 |

* cited by examiner

*Primary Examiner* — Leon W Rhodes, Jr.
(74) *Attorney, Agent, or Firm* — Foley & Lardner LLP

(57) ABSTRACT

An imaging system includes an image carrier, a charging device to form a toner image by charging a surface of the image carrier, a polishing roller, and a control device. A discharge product is generated on the surface of the image carrier as a result of charging the image carrier, and the polishing roller polishes the discharge product generated on the surface of the image carrier. The control device controls a polishing operation of the polishing roller in response to one or more detected characteristics.

17 Claims, 12 Drawing Sheets

IMAGING SYSTEM WITH POLISHING CONTROL

CROSS REFERENCE TO RELATED APPLICATIONS

This application is filed under 35 U.S.C. § 371 as a National Stage of PCT International Application No. PCT/US2019/048565, filed on Aug. 28, 2019, in the U.S. Patent and Trademark Office, which claims the priority benefit of Japanese Patent Application No. 2018-167844, filed on Sep. 7, 2018, in the Japanese Patent Office. The disclosures of PCT International Application No. PCT/US2019/048565 and Japanese Patent Application No. 2018-167844 are incorporated by reference herein in their entireties.

BACKGROUND

In an image forming apparatus, a surface of an image carrier is uniformly charged, the surface is exposed to form an electrostatic latent image, and the electrostatic latent image is developed by toner to form a toner image on the surface of the image carrier.

DETAILED DESCRIPTION

In the following description, with reference to the drawings, the same reference numbers are assigned to the same components or to similar components having the same function, and overlapping description is omitted. An imaging system may include an imaging apparatus such as a printer, an image carrier polishing system or the like mounted on the imaging apparatus, or an imaging component.

Figure 1:
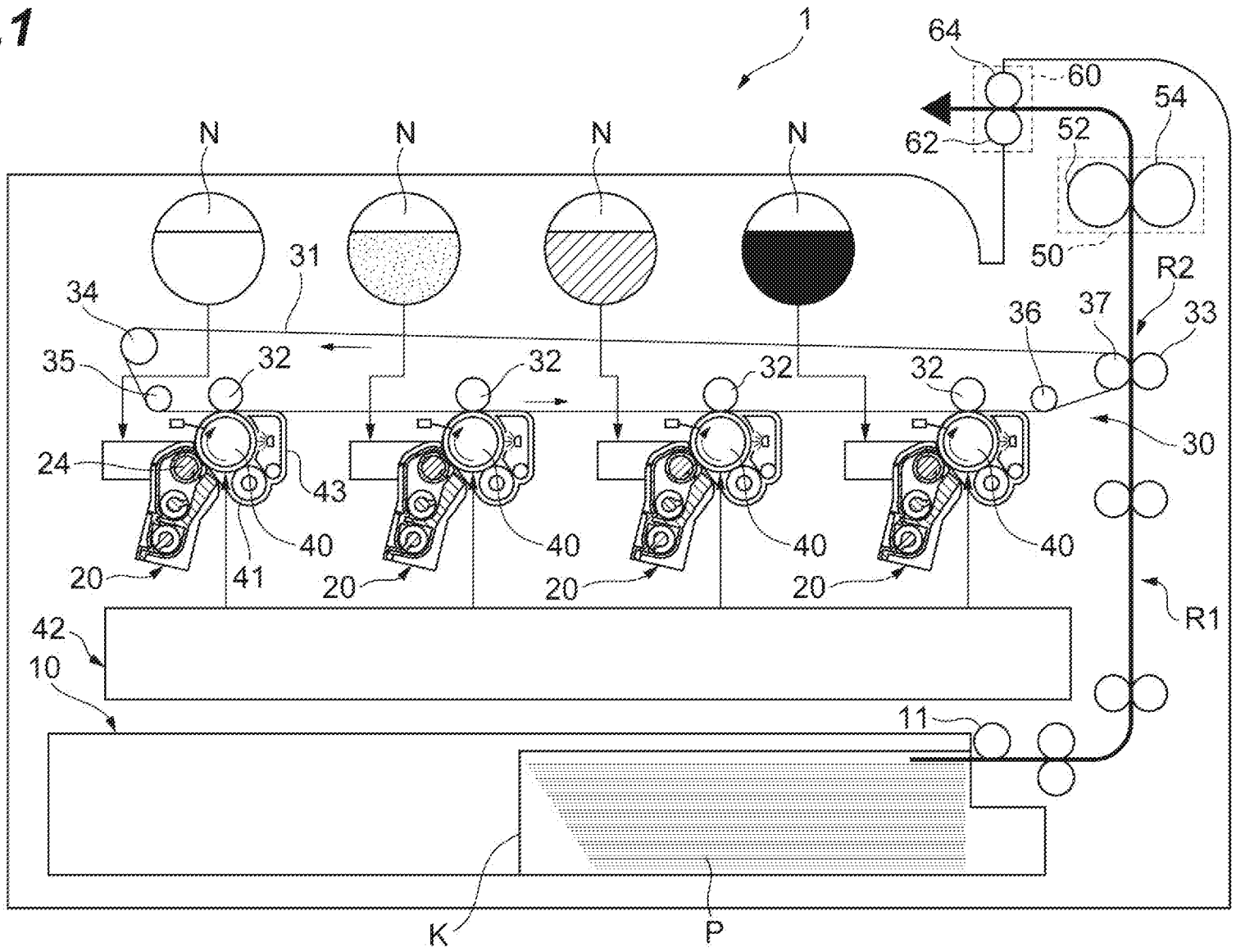
FIG. 1 is a schematic diagram of an example imaging apparatus.

FIG. 1 is a diagram illustrating a schematic configuration of an example imaging apparatus. An imaging apparatus 1 illustrated in FIG. 1 may include, for example, an apparatus which forms a color image by using magenta, yellow, cyan, and black. The imaging apparatus 1 includes, for example, a conveying device 10 which conveys a sheet P corresponding to a recording medium, a developing device 20 which develops an electrostatic latent image, a transfer device 30 which secondarily transfers a toner image to the sheet P, an image carrier 40 in which an electrostatic latent image is formed on a surface (a peripheral surface), a fixing device 50 which fixes a toner image to the sheet P, and a discharging device 60 which discharges the sheet P.

The conveying device 10 may convey the sheet P corresponding to a recording medium having an image formed thereon on a conveying route R1. The sheet P is stacked and accommodated on, for example, a cassette K and is picked up and conveyed by a feeding roller 11. The conveying device 10 allows the sheet P to reach a transfer nip portion R2 through the conveying route R1, at a timing in which the toner image transferred to the sheet P reaches a transfer nip portion R2.

The developing device 20 may be provided for each of four colors. Each developing device 20 may include a developing agent carrier 24 which carries toner on the image carrier 40. In some examples, a two-component developing agent including toner and carrier is used as a developing agent. For example, in the developing device 20, the toner and the carrier are adjusted to a predetermined or particular mixing ratio and the toner and the carrier are mixed and stirred to uniformly disperse the toner. Accordingly, the developing agent is adjusted to have an optimal charge amount. The developing agent is carried by the developing agent carrier 24. The developing agent carrier 24 rotates to carry the developing agent to a region facing the image carrier 40. Then, the toner in the developing agent carried on the developing agent carrier 24 moves to the electrostatic latent image formed on the peripheral surface of the image carrier 40 so that the electrostatic latent image is developed.

The sheet P may be conveyed to the transfer nip portion R2 in which the transfer device 30 secondarily transfers the toner image formed by the developing device 20 to the sheet P. The transfer device 30 includes, for example, a transfer belt 31 to which the toner image is initially transferred from the image carrier 40, suspension rollers 34, 35, 36, and 37 on which the transfer belt 31 are suspended, a primary transfer roller 32 which sandwiches the transfer belt 31 along with the image carrier 40, and a secondary transfer roller 33 which sandwiches the transfer belt 31 along with the suspension roller 37.

The transfer belt 31 may include an endless belt which moves in a circulating manner by the suspension rollers 34, 35, 36, and 37. Each of the suspension rollers 34, 35, 36, and 37 is a roller which is rotatable about each axis. The suspension roller 37 may include a driving roller which rotates about the axis. Each of the suspension rollers 34, 35, and 36 may include a driven roller which is rotated by the rotation of the suspension roller 37. In some examples, the primary transfer roller 32 is provided to press the image carrier 40 from the inner peripheral side of the transfer belt 31. The secondary transfer roller 33 is disposed in parallel to the suspension roller 37 with, for example, the transfer belt 31 interposed therebetween and is provided to press the suspension roller 37 from the outer peripheral side of the transfer belt 31. Accordingly, the secondary transfer roller 33 forms the transfer nip portion R2 between the transfer belt 31 and the secondary transfer roller.

The image carrier 40 may be referred to as an electrostatic latent image carrier, a photosensitive drum, or the like. The image carrier 40 may be provided for each of four colors. Each image carrier 40 may be provided along the movement direction of the transfer belt 31. In some examples, the developing device 20, a charging roller 41, an exposure device 42, and a cleaning device 43 are provided on the periphery of the image carrier 40.

The charging roller 41 may include a charging member that uniformly charges the surface of the image carrier 40 to a predetermined potential. The charging roller 41 moves, for example, to follow the rotation of the image carrier 40. The exposure device 42 may be configured to expose the surface of the image carrier 40 charged by the charging roller 41 in response to an image formed on the sheet P. Accordingly, a potential of a portion exposed by the exposure device 42 in the surface of the image carrier 40 changes so that the electrostatic latent image is formed. In some examples, four developing devices 20 form the toner images by developing the electrostatic latent image formed on the image carriers 40 using the toners supplied from toner tanks N respectively facing the developing devices 20. The toner tanks N are respectively filled with, for example, magenta, yellow, cyan, and black toners. The cleaning device 43 collects the toner remaining on the image carrier 40 after the toner image formed on the image carrier 40 is initially transferred to the transfer belt 31.

The fixing device 50 may be configured to allow the sheet P to pass through a fixing nip portion R3 for heating and pressing the sheet so that the toner image secondarily transferred from the transfer belt 31 to the sheet P is adhered and fixed to the sheet P. The fixing device 50 may include a heating roller 52 which heats the sheet P and a pressing roller 54 which presses and rotates the heating roller 52. Each of the heating roller 52 and the pressing roller 54 is formed in, for example, a cylindrical shape and the heating roller 52 includes a heat source such as a halogen lamp. The fixing nip portion R3 which is a contact region is provided between the heating roller 52 and the pressing roller 54 and the toner image is heated and fixed (e.g., fused) to the sheet P when the sheet P passes through the fixing nip portion R3.

The discharging device 60 may include discharging rollers 62 and 64 which discharge the sheet P having the toner image fixed thereto by the fixing device 50 to the outside of the apparatus.

An example printing process that may be performed by the imaging apparatus 1 will now be described. When an image signal of a recording target image is input to the imaging apparatus 1, a control device of the imaging apparatus 1 rotates the feeding roller 11 so that the sheet P stacked in the cassette K is picked up and conveyed. Then, the surface of the image carrier 40 is uniformly charged to a predetermined potential by the charging roller 41 (a charging operation). Then, a laser beam is irradiated to the surface of the image carrier 40 by the exposure device 42 based on the received image signal to form an electrostatic latent image (an exposing operation).

In the developing device 20, the electrostatic latent image is developed and a toner image is formed (a developing operation). The toner image which is formed in this way is initially transferred from the image carrier 40 to the transfer belt 31 in a region in which the image carrier 40 and the transfer belt 31 face each other (a transferring operation). The toner images formed on four image carriers 40 are sequentially superimposed on the transfer belt 31 so that one composite toner image is formed. Then, the composite toner image is secondarily transferred to the sheet P conveyed from the conveying device 10 in the transfer nip portion R2 in which the suspension roller 37 and the secondary transfer roller 33 face each other.

The sheet P to which the composite toner image is secondarily transferred is conveyed to the fixing device 50. Then, the fixing device 50 fuses or otherwise fixes the composite toner image to the sheet P by heating and pressing the sheet P between the heating roller 52 and the pressing roller 54 when the sheet P passes through the fixing nip portion R3 (a fixing operation). Next, the sheet P is discharged to the outside of the imaging apparatus 1 by the discharging rollers 62 and 64.

Additionally, when the surface of the image carrier 40 is charged by the charging roller 41, a discharge product (corona product) is generated on the surface of the image carrier 40. The discharge product may include a substance generated by the activation of ozone, nitrogen oxide, or the like generated at the time of corona discharge or a substance generated by the reaction of these substances. The discharge product may include a nitrogen-based compound such as ammonium oxalate. Then, when the discharge product absorbs moisture, the electric resistance value of the surface of the image carrier 40 is largely decreased. As a result, since the latent image charge formed on the surface of the image carrier 40 flows in the direction of the latent image plane, an electrostatic latent image is not formed and an image flow occurs. The image flow may be understood to mean a phenomenon in which an image flows to be blurred or rubbed.

Figure 2:
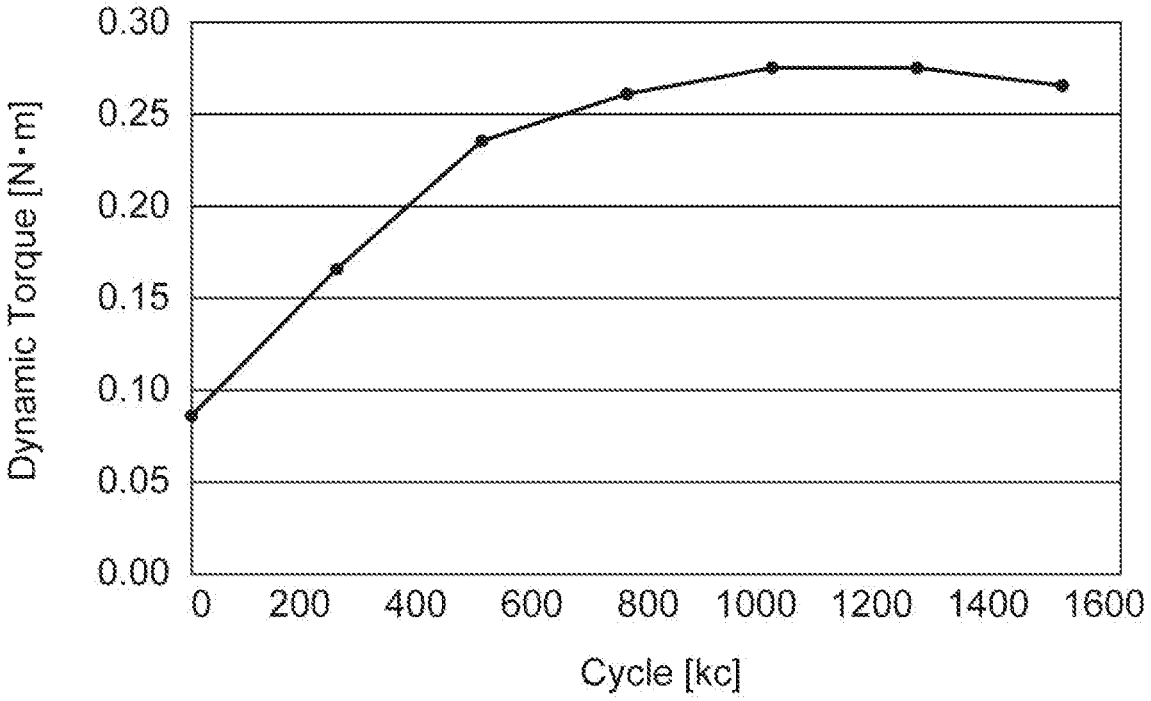
FIG. 2 is a graph illustrating an example relationship between the number of rotation cycles of an example image carrier and rotational torque of the image carrier.

FIG. 2 illustrates a relationship between the number of rotation cycles (k cycle) of the image carrier 40 and the rotational torque (dynamic torque, N·m) of the image carrier 40. As illustrated in FIG. 2, the rotational torque of the image carrier 40 tends to increase when the charging of the surface of the image carrier 40 is continued. Further, since the discharge product has viscosity, the rotational torque of the image carrier 40 increases as the amount of the discharge product generated on the surface of the image carrier 40 increases. For this reason, an increase in rotational torque of the image carrier 40 may be understood to mean that the amount of the discharge product generated on the surface of the image carrier 40 increases.

Figure 3:
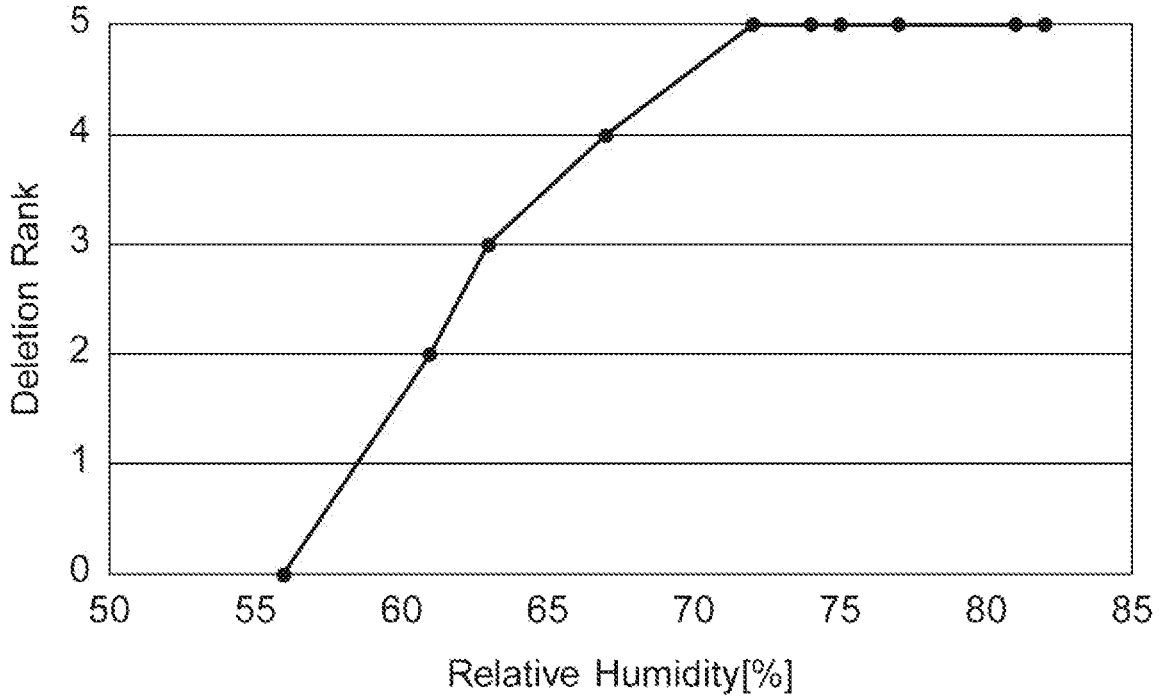
FIG. 3 is a graph illustrating an example relationship between relative humidity and image flow rank of the example imaging apparatus.

FIG. 3 illustrates a relationship between relative humidity (%) and an image flow rank of the imaging apparatus 1. The image flow rank is evaluated as six values from 0 to 5, where 0 indicates a rank in which the smallest image flow occurs, and where 5 indicates a rank in which the largest image flow occurs. As illustrated in FIG. 3, the image flow rank or degree increases as the discharge product absorbs moisture. Furthermore, the tendency is the same even when absolute humidity is used as the humidity of the imaging apparatus 1.

Figure 4:
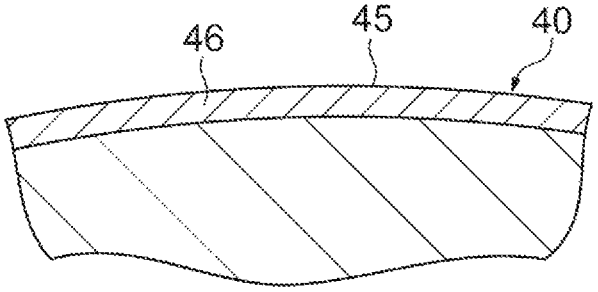
FIG. 4 is a schematic cross-sectional view illustrating a part of the example image carrier.

Since a member such as the transfer belt 31 and the charging roller 41 is in contact with the image carrier 40, the discharge product generated on the surface of the image carrier 40 is gradually removed with the rotation of the image carrier 40. However, when a surface 45 of the image carrier 40 includes a protection layer 46 as illustrated in FIG. 4, the discharge product generated on the surface of the image carrier 40 is not sufficiently removed. The protection layer 46 protects the surface 45 of the image carrier 40 in order to prolong the life of the image carrier 40. The protection layer 46 is formed on the entire periphery of the surface 45 of the image carrier 40. The material of the protection layer 46 includes, for example, a photocurable resin and a metal oxide surface treated with a phosphorus-containing compound. The above-described metal oxide includes one or more materials selected from a group including, for example, tin oxide, zinc oxide, and titanium oxide. The above-described phosphorus-containing compound may include a polymer having on its side chain a phosphorus oxo acid moiety capable of reacting with the metal oxide, a photoreactive moiety, and a lubricating moiety including one or more materials selected from the group including fluorine and silicon. The thickness of the protection layer 46 is, for example, 1.0 μm or more and 10.0 μm or less.

Figure 5:
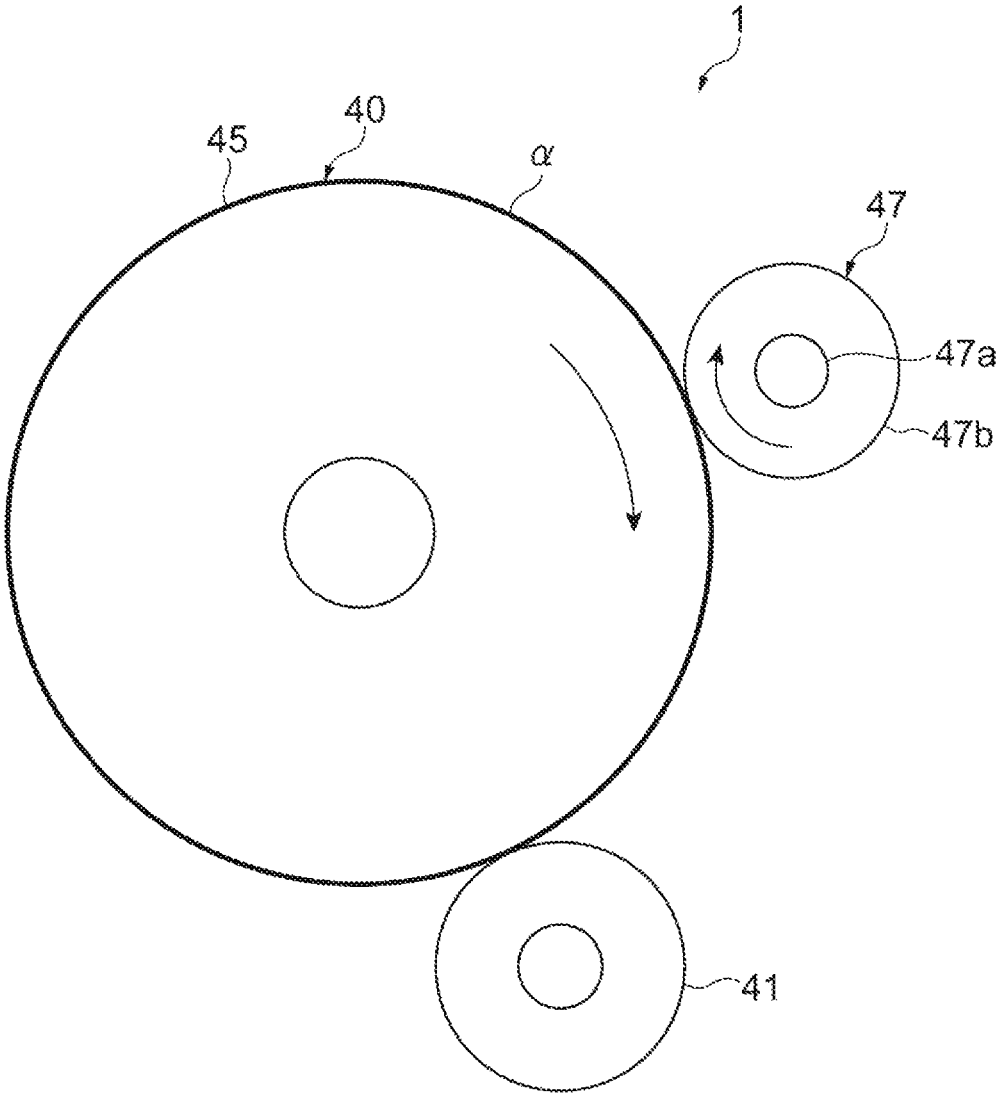
FIG. 5 is a schematic diagram illustrating a part of the example imaging apparatus.

As illustrated in FIG. 5, the imaging apparatus 1 includes a polishing roller 47. The polishing roller 47 may be disposed adjacent to the image carrier 40 and polishes the discharge product α formed on the surface 45 of the image carrier 40. The polishing roller 47 includes, for example, a roller shaft 47*a* and a polishing portion 47*b*. The roller shaft 47*a* is supported to be rotatable and is directly or indirectly connected to a rotational driving source such as a motor (not illustrated). The polishing portion 47*b* rotates to polish the discharge product α formed on the surface 45 of the image carrier 40.

Figure 6:
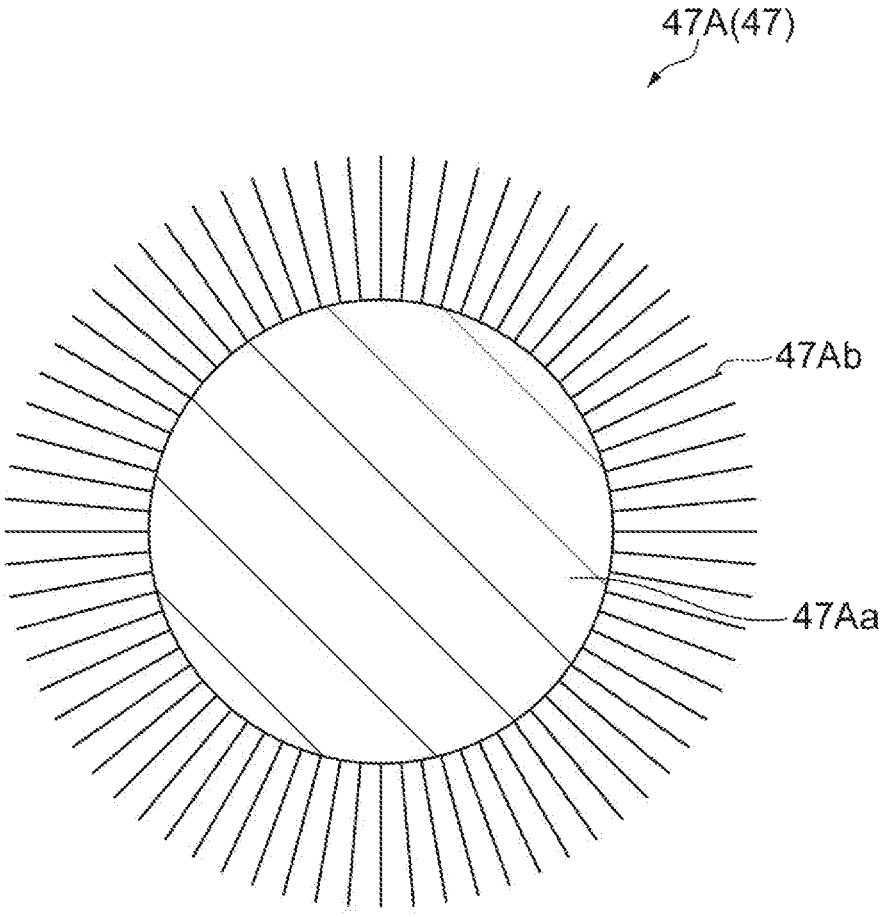
FIG. 6 is a schematic cross-sectional view of an example polishing roller.
Figure 7:
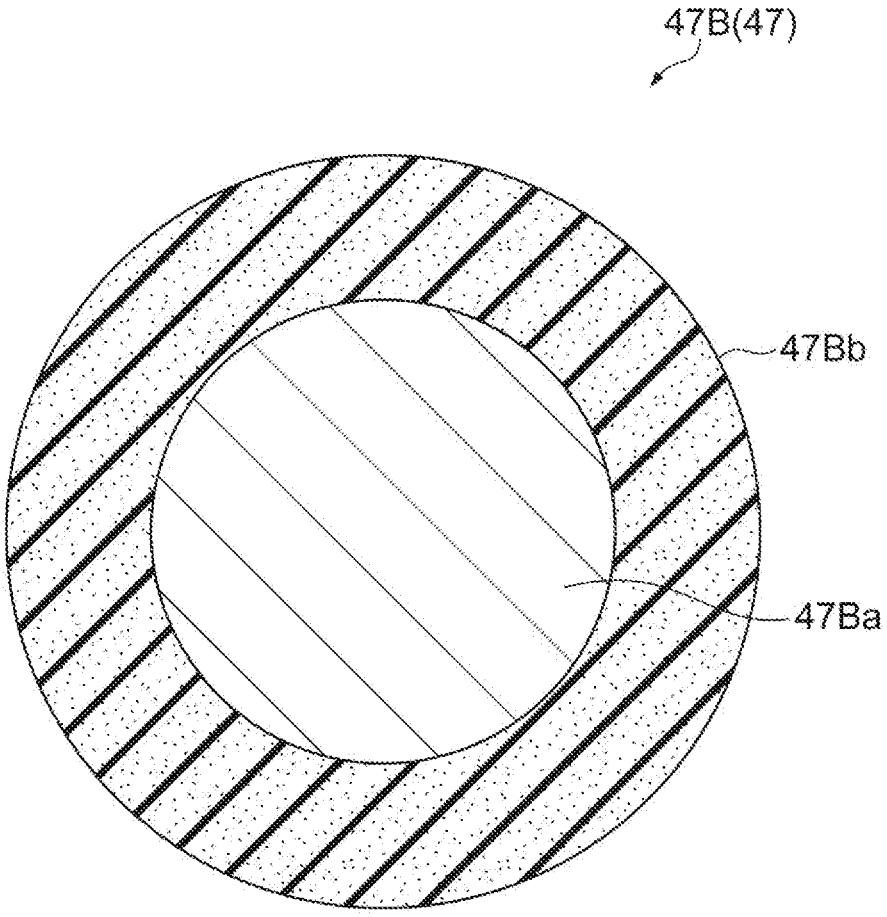
FIG. 7 is a schematic cross-sectional view of an example polishing roller.

The polishing roller 47 may include, for example, a brush roller 47A illustrated in FIG. 6, an elastic roller 47B illustrated in FIG. 7, or other types of similar rollers. The brush roller 47A may include a plurality of brush bristles 47Ab which are bristled on a peripheral surface of a roller shaft 47Aa. In the elastic roller 47B, for example, a sponge-like elastic body 47Bb is attached to a peripheral surface of a roller shaft 47Ba. The elastic body 47Bb may be made of, for example, urethane, ethylene-propylene-diene rubber (EPDM), and the like.

The polishing roller 47 may rotate in a rotational direction different from that of the image carrier 40 or may rotate in the same rotational direction as that of the image carrier 40. FIG. 5 illustrates a case in which the polishing roller 47 rotates in a rotational direction different from that of the image carrier 40 as an example. When the polishing roller 47 rotates in the same rotational direction as that of the image carrier 40, the polishing roller 47 is rotated so that the circumferential speed of the polishing roller 47 is different from that of the image carrier 40.

Figure 8:
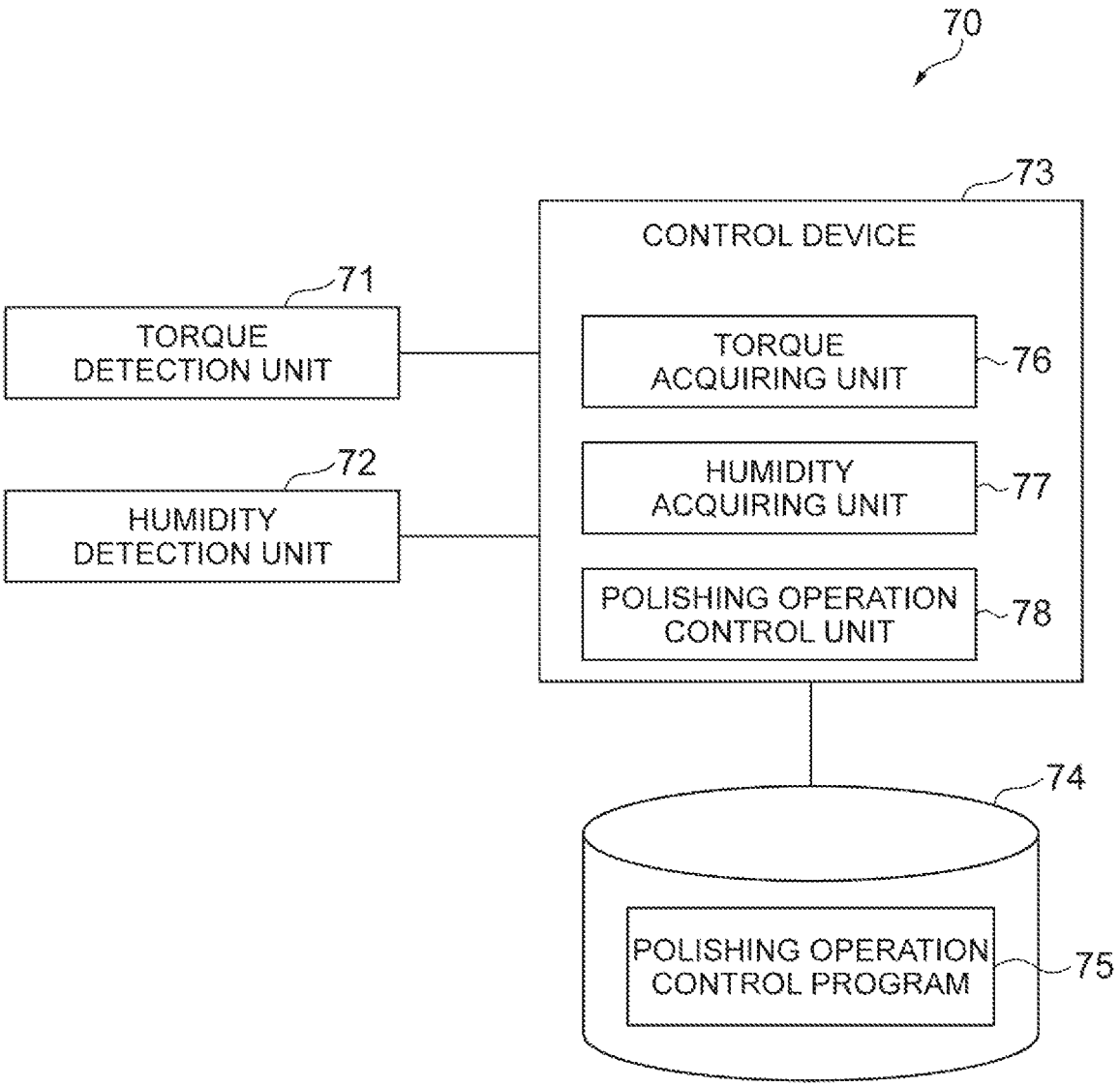
FIG. 8 is a block diagram of an example image carrier polishing system.

As illustrated in FIG. 8, the imaging apparatus 1 includes an image carrier polishing system 70. The image carrier polishing system 70 may include a torque detection device 71, a humidity detection device 72, a control device 73, and a memory 74.

The torque detection device 71 detects the torque (rotational torque and dynamic torque) of the image carrier 40. The torque detection device 71 may include, for example, a torque sensor connected to the rotation shaft of the image carrier 40.

The humidity detection device 72 detects the humidity of the imaging apparatus 1. The humidity of the imaging apparatus 1 can be set to the humidity inside the imaging apparatus 1 and can be set to the humidity in the vicinity of the image carrier 40. The humidity of the imaging apparatus 1 may be relative humidity or absolute humidity. The humidity detection device 72 may include, for example, a temperature/humidity meter installed inside the imaging apparatus 1.

The control device 73 may include an electronic control device (computer) for performing a polishing operation control process. The control device 73 is communicatively connected to the torque detection device 71 and the humidity detection device 72. The memory 74 is a computer readable memory which can be read by the control device 73. For example, the memory 74 stores a polishing operation control program 75 for performing the polishing operation control process and the control device 73 performs the polishing operation control process by reading the polishing operation control program 75 from the memory 74 and performing the program. In some examples, the polishing operation control program 75 realizes the polishing operation control process in the control device 73. The control device 73 may be a single electronic control device or a plurality of electronic control devices. The control device 73 may be used to selectively or in some cases exclusively perform the polishing operation control process or may be used to perform other controls of the imaging apparatus 1.

The control device 73 may include a torque acquiring device 76, a humidity acquiring device 77, and a polishing operation control device 78.

The torque acquiring device 76 acquires torque detected by the torque detection device 71 from the torque detection device 71. This acquired torque indicates a characteristic detected by the torque detection device 71. The humidity acquiring device 77 acquires humidity detected by the humidity detection device 72 from the humidity detection device 72. This acquired humidity is a characteristic detected by the humidity detection device 72.

The polishing operation control device 78 controls the polishing operation of the polishing roller 47 in response to the detected characteristics. In some examples, the polishing operation control device 78 adjusts a polishing force of the polishing roller 47 with respect to the surface 45 of the image carrier 40 in response to the detected characteristics.

The detected characteristics include torque acquired by the torque acquiring device 76, humidity acquired by the humidity acquiring device 77, and the like. In some examples, the detected characteristics may be understood to mean the torque acquired by the torque acquiring device 76 and the humidity acquired by the humidity acquiring device 77.

The polishing operation (e.g., the polishing force of the polishing roller 47 with respect to the surface 45 of the image carrier 40) can be adjusted by a plurality of adjustment operations, for example, (1) the adjustment of the rotation speed of the polishing roller 47, (2) the adjustment of the pressure of the polishing roller 47 with respect to the surface 45 of the image carrier 40, and (3) the adjustment of the abrasive supply amount with respect to the polishing roller 47.

Regarding the adjustment of the rotation speed of the polishing roller 47 (adjustment operation 1), the polishing force of the polishing roller 47 with respect to the surface 45 of the image carrier 40 increases as the rotation speed of the polishing roller 47 increases. Additionally, the polishing force of the polishing roller 47 with respect to the surface 45 of the image carrier 40 decreases as the rotation speed of the polishing roller 47 decreases.

Figure 9:
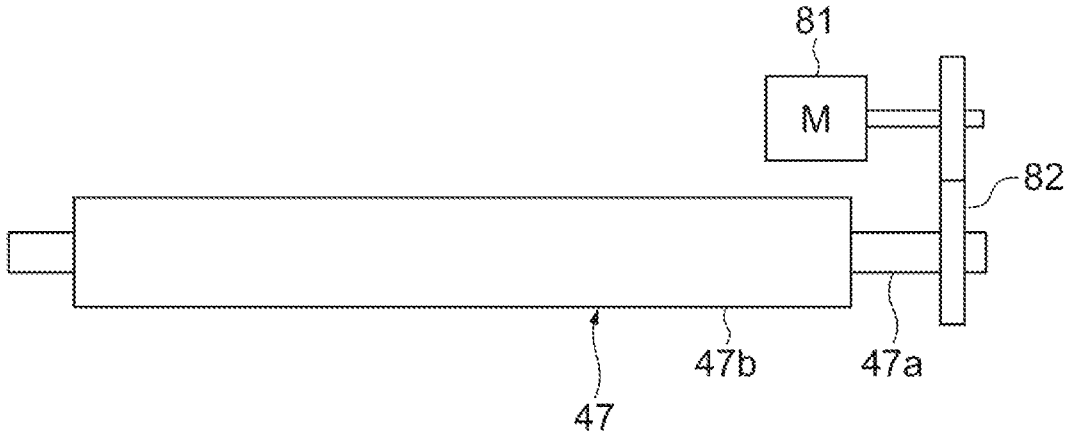
FIG. 9 is a schematic diagram illustrating an example polishing motion control.

In some examples, as illustrated in FIG. 9, the polishing roller 47 rotates by obtaining a rotational driving force from a rotational driving source 81 such as a motor. Accordingly, the rotation speed of the polishing roller 47 may be selectively varied by adjusting the rotation speed of the rotational driving source 81. Further, when a gear mechanism 82 is disposed between the rotational driving source 81 and the roller shaft 47*a* of the polishing roller 47, the rotation speed of the polishing roller 47 may be adjusted by changing the gear ratio (speed reduction ratio) of the gear mechanism 82. The adjustment of the rotation speed of the rotational driving source 81 can be performed by adjusting, for example, a current amount supplied to the rotational driving source 81. Additionally, the change of the gear ratio can be performed by using a gear mechanism having a variable gear stage as the gear mechanism 82 and changing the gear stage of the gear mechanism 82.

(Regarding the adjustment of the pressure of the polishing roller 47 with respect to the surface 45 of the image carrier 40 (adjustment operation 2), the polishing force of the polishing roller 47 with respect to the surface 45 of the image carrier 40 increases as the pressure of the polishing roller 47 with respect to the surface 45 of the image carrier 40 increases. Additionally, the polishing force of the polishing roller 47 with respect to the surface 45 of the image carrier 40 decreases as the pressure of the polishing roller 47 with respect to the surface 45 of the image carrier 40 decreases.

Figure 10:
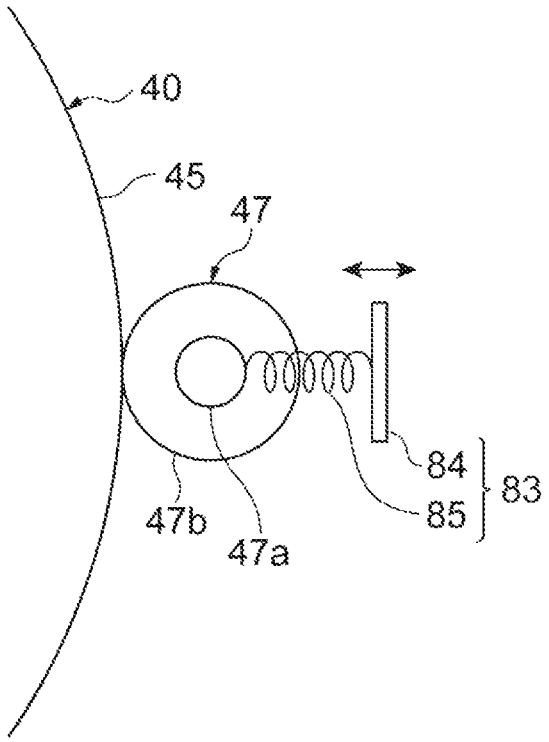
FIG. 10 is a schematic diagram illustrating another example polishing motion control.

In some examples, with reference to FIG. 10, a pressing mechanism 83 presses the surface 45 of the image carrier 40 by the polishing roller 47. The pressing mechanism 83 may include a support portion 84 and an urging member 85 such as a coil spring disposed between the roller shaft 47*a* of the polishing roller 47 and the support portion 84. The pressing mechanism 83 presses the roller shaft 47*a* of the polishing roller 47 against the surface 45 of the image carrier 40 by the urging member 85 supported by the support portion 84. In some examples, when the support portion 84 is moved in a direction moving close to and away from the roller shaft 47*a*, the pressure of the polishing roller 47 with respect to the surface 45 of the image carrier 40 can be adjusted. For example, the movement of the support portion 84 can be performed by fitting the support portion 84 to a guide rail (not illustrated) extending in a direction moving close to and away from the roller shaft 47*a* and moving the support portion 84 along the guide rail by an electric motor (not illustrated) such as a motor.

Regarding the adjustment of the abrasive supply amount with respect to the polishing roller 47 (adjustment operation 3), the polishing force of the polishing roller 47 with respect to the surface 45 of the image carrier 40 increases as the abrasive supply amount with respect to the polishing roller 47 increases. Additionally, the polishing force of the polishing roller 47 with respect to the surface 45 of the image carrier 40 decreases as the abrasive supply amount with respect to the polishing roller 47 decreases.

Figure 11:
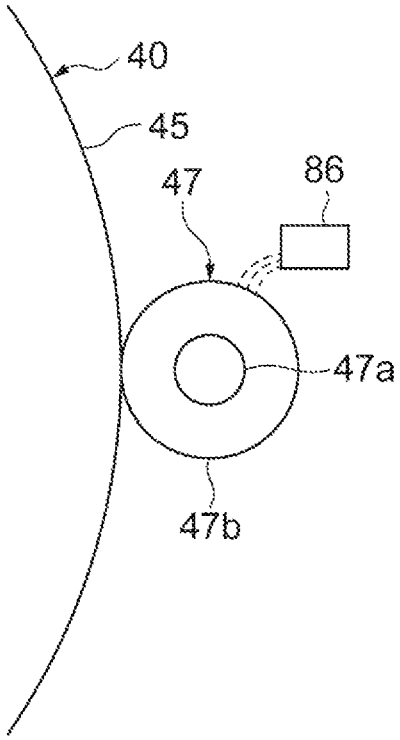
FIG. 11 is a schematic diagram illustrating yet another example polishing motion control.

In some examples, with reference to FIG. 11, an abrasive supply device 86 may supply an abrasive such as toner to the polishing roller 47. The abrasive supply device 86 increases the polishing force of the polishing roller 47 by supplying the abrasive to the polishing roller 47. In some examples, when the abrasive supply amount from the abrasive supply device 86 to the polishing roller 47 is adjusted, the pressure of the polishing roller 47 with respect to the surface 45 of the image carrier 40 can be adjusted. When the toner is used as the abrasive, for example, the abrasive can be removed from the polishing roller 47 by adhering the abrasive to a flicker roller to which a voltage is applied and scraping off the abrasive adhered to the flicker roller with a scraper. Further, when the toner is used as the abrasive, the toner moved from the polishing roller 47 to the image carrier 40 can be collected by the cleaning device 43.

The control device 73 may be configured to control the polishing operation of the polishing roller 47 so that the polishing force of the polishing roller 47 with respect to the surface 45 of the image carrier 40 increases as the humidity of the imaging apparatus 1 increases. Additionally, the control device 73 may control the polishing operation of the polishing roller 47 so that the polishing force of the polishing roller 47 with respect to the surface 45 of the image carrier 40 decreases as the humidity of the imaging apparatus 1 decreases. The control of the polishing operation of the polishing roller 47 may be continuously or incrementally performed in response to the humidity of the imaging apparatus 1. When the control of the polishing operation of the polishing roller 47 is performed incrementally (stepwise), the control device 73 adjusts, for example, the polishing operation of the polishing roller 47 so that the polishing force of the polishing roller 47 with respect to the surface 45 of the image carrier 40 increases when the humidity of the imaging apparatus 1 becomes higher than the reference humidity. Additionally, the control device 73 may adjust the polishing operation of the polishing roller 47 so that the polishing force of the polishing roller 47 with respect to the surface 45 of the image carrier 40 decreases when the humidity of the imaging apparatus 1 becomes equal to or lower than the reference humidity. The reference humidity may be an arbitrary value that is set to, for example, the humidity determined by experiments or the like when the image flow occurs.

The control device 73 may be configured to control the polishing operation of the polishing roller 47 so that the polishing force of the polishing roller 47 with respect to the surface 45 of the image carrier 40 increases as the torque of the image carrier 40 increases. Additionally, the control device 73 controls, for example, the polishing operation of the polishing roller 47 so that the polishing force of the polishing roller 47 with respect to the surface 45 of the image carrier 40 decreases as the torque of the image carrier 40 decreases. The control of the polishing operation of the polishing roller 47 may be performed either continuously or stepwise in response to the torque of the image carrier 40. When the control of the polishing operation of the polishing roller 47 is performed stepwise, the control device 73 adjusts, for example, the polishing operation of the polishing roller 47 so that the polishing force of the polishing roller 47 with respect to the surface 45 of the image carrier 40 increases when the torque of the image carrier 40 becomes larger than the reference torque. Additionally, the control device 73 may be configured to adjust the polishing operation of the polishing roller 47 so that the polishing force of the polishing roller 47 with respect to the surface 45 of the image carrier 40 decreases when the torque of the image carrier 40 becomes equal to or smaller than the reference torque. The reference torque may be an arbitrary value that is set to, for example, the torque obtained by experiments or the like when the thickness of the discharge product becomes a predetermined value.

A example control process of the polishing operation which may be performed by the control device 73 will now be described with reference to FIG. 12. The process may be performed by the control device 73 by, for example, reading the polishing operation control program 75 from the memory 74 and performing the program. Furthermore, part of the operations shown below may be performed at the same time or may be performed in a different order from that shown.

Figure 12:
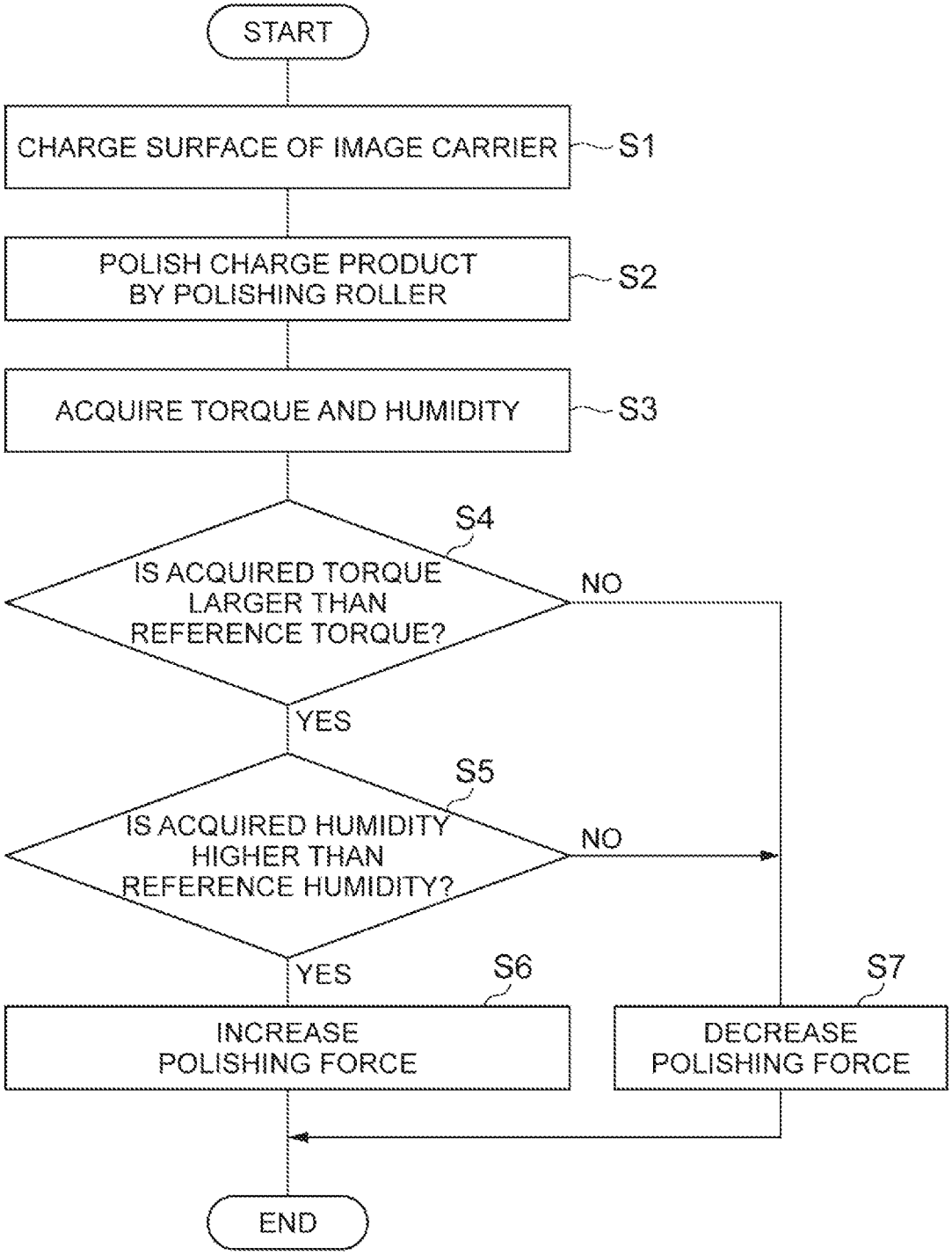
FIG. 12 is a flowchart illustrating an example polishing operation control process.

As illustrated in FIG. 12, the control device 73 uniformly charges the surface 45 of the image carrier 40 to a predetermined potential by the charging roller 41 (operation S1). Accordingly, the discharge product $\alpha$ is generated on the surface 45 of the image carrier 40.

At operation S2, the control device 73 polishes the discharge product $\alpha$ generated on the surface 45 of the image carrier 40 by the charging of the image carrier 40 by the polishing roller. At this time, the control device 73 may perform the polishing operation of the polishing roller 47 in a condition set to an initial value.

At operation S3, the control device 73 acquires the torque acquired by the torque acquiring device 76 and the humidity acquired by the humidity acquiring device 77 as the detected characteristics.

Then, the control device 73 controls the polishing operation of the polishing roller 47 so that the polishing force of the polishing roller 47 with respect to the surface 45 of the image carrier 40 increases as the torque acquired by operation S3 increases. Further, the control device 73 controls the polishing operation of the polishing roller 47 so that the polishing force of the polishing roller 47 with respect to the surface 45 of the image carrier 40 increases as the humidity acquired by operation S3 increases. The control device 73 may control the polishing operation of the polishing roller 47 so that the polishing force of the polishing roller 47 with respect to the surface 45 of the image carrier 40 increases as the torque acquired by operation S3 increases.

In some examples, the control device 73 determines whether the torque acquired by operation S3 is larger than the reference torque (operation S4). When it is determined that the torque acquired by operation S3 is larger than the reference torque (operation S4: YES), the control device 73 then determines whether the humidity acquired by operation S3 is higher than the reference humidity (operation S5). When it is determined that the humidity acquired by operation S3 is higher than the reference humidity (operation S5: YES), the control device 73 controls the polishing operation of the polishing roller 47 so that the polishing force of the polishing roller 47 with respect to the surface 45 of the image carrier 40 increases (operation S6). Additionally, when it is determined that the torque acquired by operation S3 is equal to or smaller than the reference torque (operation S4: NO) or the humidity acquired by operation S3 is equal to or lower than the reference humidity (operation S5: NO), the control device 73 controls the polishing operation of the polishing roller 47 so that the polishing force of the polishing roller 47 with respect to the surface 45 of the image carrier 40 decreases (operation S7).

The control of the polishing operation of the polishing roller 47 is performed by a plurality of adjustment operations, for example, (1) the adjustment of the rotation speed of the polishing roller 47, (2) the adjustment of the pressure of the polishing roller 47 with respect to the surface 45 of the image carrier 40, and (3) the adjustment of the abrasive supply amount with respect to the polishing roller 47.

In some examples, since the discharge product α is generated on the surface 45 of the image carrier 40 by the charging of the image carrier 40, the discharge product α is polished by the polishing roller 47. Additionally, the control device 73 can appropriately remove the discharge product α from the surface 45 of the image carrier 40 in order to control the polishing operation of the polishing roller 47 in response to the detected characteristics. Accordingly, the occurrence of the image flow may be prevented.

The control device 73 can readily adjust the polishing force of the polishing roller 47 with respect to the surface 45 of the image carrier 40 by adjusting the rotation speed of the polishing roller (adjustment operation 1), by adjusting the pressure of the polishing roller with respect to the surface of the image carrier (adjustment operation 2), or by adjusting the abrasive supply amount with respect to the polishing roller 47 as the polishing operation of the polishing roller 47 (adjustment operation 3).

The control device 73 can effectively prevent the occurrence of the image flow by controlling the polishing operation of the polishing roller 47 based on the humidity of the imaging apparatus 1 and the torque of the image carrier 40.

When the polishing roller 47 and the image carrier 40 rotate in different rotational directions, a rotational friction is generated between the polishing roller 47 and the image carrier 40 regardless of the rotation speed of the polishing roller 47. Accordingly, the discharge product α generated on the surface 45 of the image carrier 40 may be polished. Additionally, since the polishing roller 47 is rotated so that the circumferential speed of the polishing roller 47 is different from the circumferential speed of the image carrier 40 when the polishing roller 47 and the image carrier 40 rotate in the same rotational direction, a rotational friction is generated between the polishing roller 47 and the image carrier 40. Accordingly, the discharge product α generated on the surface 45 of the image carrier 40 may be polished.

It is to be understood that not all aspects, advantages and features described herein may necessarily be achieved by, or included in, any one particular example. Indeed, having described and illustrated various examples herein, it should be apparent that other examples may be modified in arrangement and detail.

The invention claimed is:

1. An imaging system comprising:

a rotatable image carrier;

a charging device, located adjacent to the image carrier, to charge the image carrier and to form a toner image on a surface of the image carrier, wherein a discharge product is generated on the surface of the image carrier as a result of charging the image carrier;

a polishing roller, located adjacent to the image carrier, to polish the discharge product generated on the surface of the image carrier; and a control device to control a polishing operation, from among polishing operations, of the polishing roller in response to one or more detected characteristics, wherein the one or more detected characteristics include a detected torque value of the image carrier and a detected humidity value of the imaging system, and in response to both of the detected torque value and the detected humidity value being higher than respective torque and humidity reference values, the polishing operation includes an adjustment of a polishing force applied by the polishing roller.

2. The imaging system according to claim 1, wherein the adjustment of the polishing force includes an adjustment of a rotation speed of the polishing roller.

3. The imaging system according to claim 1, comprising:

a pressing mechanism to press the polishing roller against the surface of the image carrier, wherein the adjustment of the polishing force includes an adjustment of a pressure of the polishing roller with respect to the surface of the image carrier by way of the pressing mechanism.

4. The imaging system according to claim 1, comprising:

an abrasive supply device to supply the abrasive to the polishing roller, wherein the adjustment of the polishing force includes an adjustment of a supply amount of an abrasive supplied to the polishing roller.

5. The imaging system according to claim 1, the control device is to control the polishing operation of the polishing roller so that the adjustment of the polishing force of the polishing roller includes increasing the polishing force with respect to the surface of the image carrier as the humidity of the imaging system increases.

6. The imaging system according to claim 1,
the control device is to control the polishing operation of the polishing roller so that the adjustment of the polishing force of the polishing roller includes increasing the polishing force with respect to the surface of the image carrier as the torque of the image carrier increases.

7. The imaging system according to claim 1,
wherein the polishing roller and the image carrier rotate in different rotational directions.

8. The imaging system according to claim 1,
wherein the polishing roller and the image carrier rotate in a same rotational direction so that rotational friction is generated between the polishing roller and the image carrier.

9. The imaging system according to claim 1,
wherein the surface of the image carrier includes a protection layer, and
wherein the discharge product is generated on the surface of the protection layer.

10. An imaging system comprising:
an image carrier;
a charging device to form a toner image by charging a surface of the image carrier, wherein a discharge product is generated on the surface of the image carrier as a result of charging the image carrier;
a polishing roller to polish the discharge product generated on the surface of the image carrier; and
a control device to adjust a polishing force of the polishing roller with respect to the surface of the image carrier in response to one or more detected characteristics including a detected torque value of the image carrier and a detected humidity value of the imaging system,
the polishing force being adjusted in response to both of the detected torque value and the detected humidity value being higher than respective torque and humidity reference values.

11. An image carrier polishing method comprising:
charging a surface of a rotatable image carrier to form a toner image;
polishing, by a polishing roller, a discharge product generated on the surface of the image carrier, wherein the discharged product is generated as a result of charging the image carrier; and
controlling a polishing operation, from among polishing operations, of the polishing roller in response to one or more detected characteristics,
wherein
the one or more detected characteristics include a detected torque value of the image carrier and a detected humidity value of the imaging system, and
in response to both of the detected torque value and the detected humidity value being higher than respective torque and humidity reference values, the polishing operation includes an adjustment of a polishing force applied by the polishing roller.

12. The image carrier polishing method according to claim 11,
wherein the polishing operation of the polishing roller is controlled so that the adjustment of the polishing force of the polishing roller includes increasing the polishing force with respect to the surface of the image carrier as the humidity increases.

13. The image carrier polishing method according to claim 11,
wherein the polishing operation of the polishing roller is controlled so that the adjustment of the polishing force of the polishing roller includes increasing the polishing force with respect to the surface of the image carrier as the torque of the image carrier increases.

14. The imaging system according to claim 10, wherein the adjustment of the polishing force includes at least one polishing operation from among polishing operations of an adjustment of a supply amount of an abrasive supplied to the polishing roller, an adjustment of a pressure of the polishing roller with respect to the surface of the image carrier, and an adjustment of a rotation speed of the polishing roller.

15. The image carrier polishing method according to claim 11,
wherein the polishing roller and the image carrier rotate in different rotational directions.

16. The image carrier polishing method according to claim 11,
wherein the polishing roller and the image carrier rotate in a same rotational direction so that rotational friction is generated between the polishing roller and the image carrier.

17. The image carrier polishing method according to claim 11,
wherein the surface of the image carrier includes a protection layer, and
wherein the discharge product is generated on the surface of the protection layer.

* * * * *